United States Patent [19]

Groves

[11] Patent Number: 4,515,349

[45] Date of Patent: May 7, 1985

[54] INTEGRAL VEGETATION BARRIER

[75] Inventor: George D. Groves, Jefferson County, Mo.

[73] Assignee: B. & G. Consultants, Inc., Arnold, Mo.

[21] Appl. No.: 565,410

[22] Filed: Dec. 27, 1983

[51] Int. Cl.[3] ..... E04H 17/06

[52] U.S. Cl. ..... 256/1; 256/32

[58] Field of Search ..... 256/1, 32

[56] References Cited

U.S. PATENT DOCUMENTS

| | | | |
|---|---|---|---|
| 3,393,897 | 7/1968 | Wright | 256/32 |
| 3,515,373 | 6/1970 | Abbe | 256/1 X |
| 3,713,624 | 1/1973 | Niemann | 256/32 |
| 3,768,780 | 10/1973 | Cowles | 256/1 |
| 3,806,096 | 4/1974 | Eccleston | 256/1 X |

*Primary Examiner*—Andrew V. Kundrat
*Attorney, Agent, or Firm*—Paul M. Denk

[57] ABSTRACT

An integral fence associated vegetation barrier for eliminating growth of grass, or the like, and having a base member, an integrally and upwardly extending leg arranged approximately centrally, or slightly off center thereof, projecting up a sufficient distance to allow for its tying to the bottom of any fence, incorporating a series of apertures therein to facilitate the tying of the barrier to the bottom of the fence, and also having a plurality of spacially arranged drainage openings to facilitate the flow of rain or water therethrough; the formed barrier, constructed of a polymer, rubber, or the like, may have its upstanding leg folded over into adjacency with its base member, to ease its rolling into the roll form, as for storage, transit, or merchandising.

8 Claims, 3 Drawing Figures

FIG. 1.
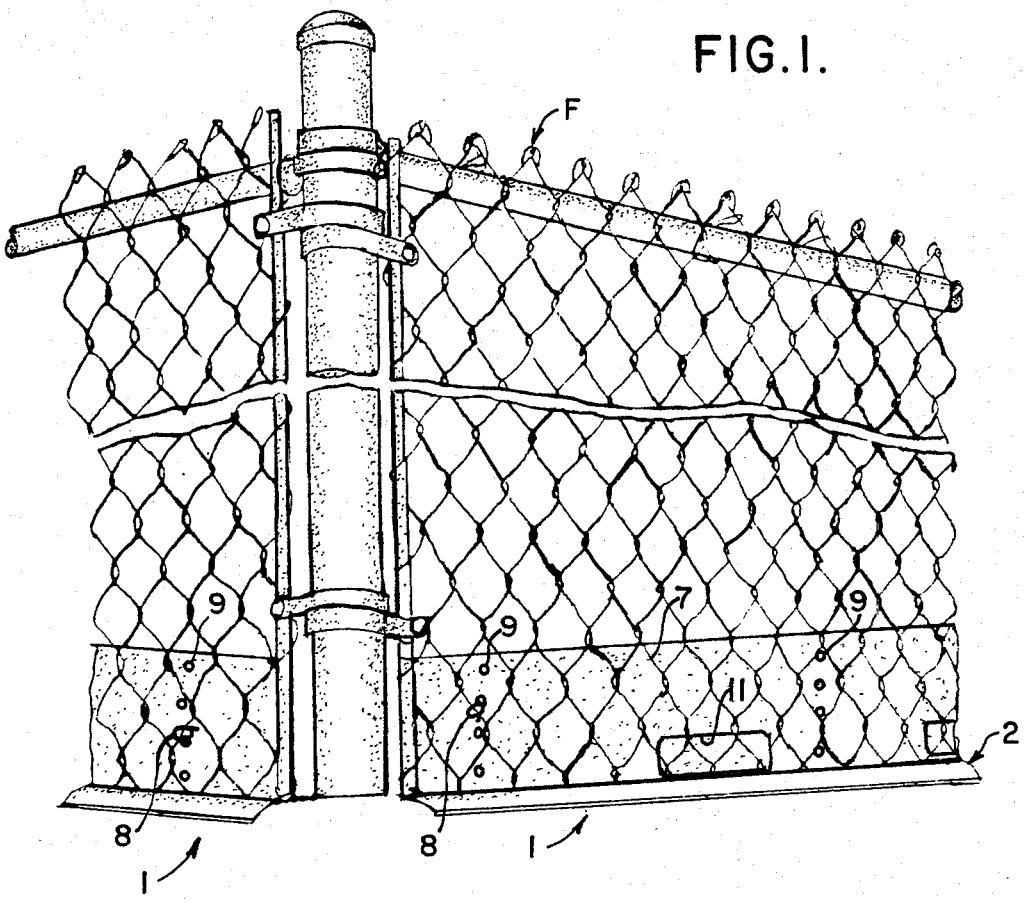
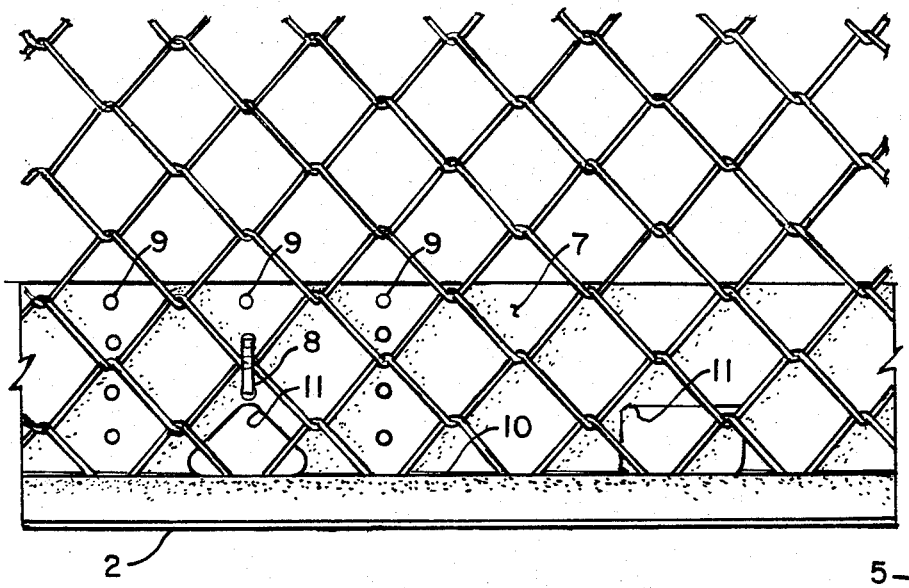
FIG. 2.
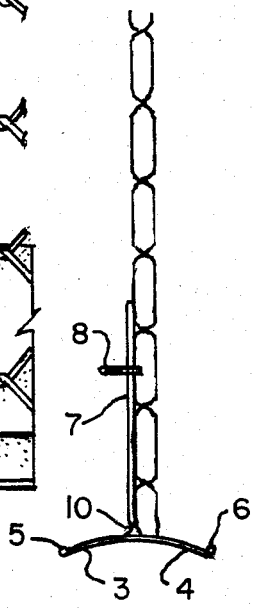
FIG. 3.

INTEGRAL VEGETATION BARRIER

BACKGROUND OF THE INVENTION

This invention relates generally to a vegetation guard, and more specifically pertains to the application of integrally formed barrier for use in conjunction underneath various types of fencing in order to prevent the growth of vegetation in proximity therewith, and to facilitate the cutting of grass or other weeds that may grow laterally of the applied barrier.

Various types of weed barriers have been developed in the prior art. Generally, they focus upon the application of some type of base that is supplied under fencing and is designed to prevent and retard the growth of grass or other weeds at that location, and to ease the movement of a lawn mower or other cutter into a close proximity with the fence, in order that all of the brush may be readily cut and removed, and thereby provide a rather clean-cut appearance to the manicured lawn particularly at such locations. For example, the patent to Niemann, U.S. Pat. No. 3,713,624, shows such a fence guard, and which is generally satisfactory in operation for the purposes as shown and described therein, but the one difference between this particular piece of prior art, and which makes it a little difficult of application, is the fact that it does come in two parts, and requires at least two people to apply it as the two halves of the fence guard are brought into proximity and clasped together, by way of the device's formed locking means, as shown.

Various other patents have issued upon related types of fence bordering means, such as shown in the U.S. Pat. No. 3,768,780, wherein the border means as shown incorporates an upwardly disposed slot, and which is disposed for insertion of the bottom of the fence therein, having flared lower flat pannels extending therefrom. This particular border is also effective for its intended usage, but is applied quite differently from the vegetation barrier of this current invention, and in addition, it is structurally different and requires a different form of application.

The U.S. Pat. No. 3,806,096, shows a fence trim and vegetation barrier, which, once again, is constructed of its own particular configuration, and which functions in the nature of a series of aligned shells in which extension cores must be inserted in order to apply the disclosed barrier. One problem with this particular design is that it is generally fixed with respect to its length, and does require a differently shaped type of core means in order to connect the various shells together. The U.S. Pat. No. 4,321,769, shows an edging strip, of the type that may be buried partially in the ground in order to expose its upward convex surface for use for edging walks, borders, or the like. The U.S. Pat. to Snider, No. 4,349,989, discloses another form of fence guard, having its own peculiar structure. And, the U.S. Pat. to Jensen, No. 3,545,127, discloses another type of lawn edging arrangement, once again, having its own particular configuration and structure. U.S. Pat. No. 3,515,373, shows a fence trim guard, not too unlike that which was previously described with respect to the U.S. Pat. No. 3,806,096. Finally, U.S. Pat. No. 4,219,941, discloses a moisture barrier for fruit drying trays or the like. Most of these prior devices are structured quite differently from the fabrication of the current vegetation barrier, of this invention, and those which are designed for use particularly as a fence guard, such as the Niemann patent device, are also structured differently and require different application even though the similar type of end results may be obtained.

It is, therefore, the principal object of this invention to provide an integrally structured vegetation barrier primarily for use under fencing, and which can be applied by a single worker, in order to achieve highly satisfactory results in retarding the growth of grass, weeds, or the like at the base of a fence.

Another object of this invention is to provide a vegetation barrier, having laterally disposed portions, and which upon one wheel of a lawn mower may ride so that a clean cut can be obtained for grass up to the fence line.

Still another object of this invention is to provide a grass barrier that conveniently allows the drainage of rain or other water therepast all at the same time preventing the growth of any grass or other vegetation in proximity therewith.

Still another object of this invention is to provide a vegetation barrier that may be applied and tied in place at the lower end or edge of a fence.

Yet another and important object of this invention is to provide an integrally formed fence vegetation barrier and which can be manufactured for shipment and placed into the roll form, to facilitate its transit and storage, and even display for merchandising, but yet when unrolled for application provides a ready and convenient barrier that may be tied in place at the lower end of the fencing.

Yet another object of this invention is to provide a vegetation barrier that can be conveniently tied and affixed in place to the bottom edge of a fence, such as the chain link fence, chicken wire fence, hog wire fence, or the like, and which can even be nailed or tied in place to existing wood fences.

These and other objects will become more apparent to those skilled in the art upon reviewing the summary of this invention, and upon undertaking a study of the description of the preferred embodiment.

SUMMARY OF THE INVENTION

This invention comtemplates the formation of an integrally formed vegetation barrier of the type that eliminates the growth of grass, weeds, or the like in the vicinity of and usually under the lower edges of various types of fences. The vegetation barrier, since it is integrally formed, and generally molded of a flexible polymer or rubber based material can be folded over into a flattened condition, and rolled into the roll form, in order to facilitate its handling, storage, shipment, packaging, and while displayed for merchandising.

This vegetation barrier incorporates a base member that is of sufficient width so as to allow for its laterally disposed surfaces to extend a reasonable distance to either side of the fence to which it is affixed, so as to prevent the growth of vegetation into proximity with the fence, and also readily provide a surface upon which at least one wheel of the lawn mower may ride, so as to provide a clean cut of the grass up to the barrier, and thereby provide a well manicured lawn along the length of the located fence. Extending integrally upwardly from the base member, and approximately centrally thereof, or slightly off centered from the same, is a singular upstanding leg, that rises up a sufficient distance, anywhere from two to six inches, or even more, and which will be located adjacent to the bottom edge of the fence, and which can be tied in place by means of any convenient tying means, such as the usual style of plastic ties, rope, wire, or the like, that are readily available upon the market. In addition, the upstanding leg has a series of arranged apertures therein, and through which the tie means or other fastener may be arranged so as to facilitate the securement of the vegetation barrier to the adjacent fence. Furthermore, the upstanding leg may contain at spaced apart distances various drainage openings therethrough, and through which rain or other water may conveniently flow so as to obtain a path of travel for such accumulations of water and allow its bypassing of the fence, without necessitating its flow under this barrier, which may otherwise cause erosion, such as can occur with many of the fence guards of the type that have been previously patented, which may be available upon the market.

In essence, the concept of this invention to provide a singularly structured vegetation barrier, one that is conveniently resilient in structure, so that all of its various structural parts can be folded over into a flattened condition, and facilitate its rolling into the compact form, but yet which can be easily opened for ready application as required.

BRIEF DESCRIPTION OF THE DRAWING

In referring to the drawings, FIG. 1 discloses a standard chain link type fence and having the vegetation barrier of this invention being affixed at its lower edges;

FIG. 2 provides a side view of a part of the foregoing fence, and showing the vegetation barrier of this invention as being tied in place;

And, FIG. 3 provides an end view of the vegetation barrier of this invention as tied in place proximate the lower edge of a chain link or other style of fence.

DESCRIPTION OF THE PREFERRED EMBODIMENT

In referring to the drawings, in particular FIGS. 1–3, therein can be seen the standard style of chain link fence F, one of the type of fencing material with which the vegetation barrier 1 of this invention may be applied. As previously stated, though, it is just as likely that this barrier may be affixed to the lower end of any of the many styles of fencing material that are used in the construction of fences of this type.

The vegetation barrier of this invention includes a base member 2 which includes a pair of laterally disposed portions, as at 3 and 4, and which may be slightly convex, in cross-section, as can be seen in FIG. 3, in order to provide for its biasing against the ground particularly at its outer edges, as at 5 and 6 respectively, to assure that the barrier is pressed firmly against the ground, for reasons that will be subsequently described. In addition, during the molding of this barrier, as from a polymer, rubber, or other compound, a bead of material, such as shown at the edges 5 and 6, may be included thereat, to provide structural reinforcement for the base member.

It is to be noted that there is an upstanding leg 7 extending integrally upwardly from approximately, or slightly off centered, of the upper surface of the base member 2, so that when the barrier is affixed in place with the lower edges of the fence, this leg may be forced into contact against the lower side edge of any fence, and disposed at this location, can be easily tied or affixed in place permanently to the fence. The usual style of ties, is at 8, may be arranged through aligned apertures, as at 9, conveniently molded through the prepared barrier, so that the barrier can be secured to the lower edge of the fence, forward downwardly to its fullest extent, and then tied in place by the application of a tie means, such as the tie 8, arranged through those particular aperture 9 that conveniently will hold the vegetation barrier into its arranged position.

It is also to be noted that at the juncture where the upstanding leg 7 of the barrier is formed with the upper surface of the base member 2, that a slightly weakened line of groove, as at 10, is provided, so as to allow the ease of folding over of the said leg 7, into adjacency with the formed base member 2, in order to provide a flattened and laminated type of configuration, which will then allow the entire barrier to be rolled up into the roll form, as after manufacture, and to facilitate its packaging, shipment, and display for merchandising. Then, when ready for application, the barrier can be removed from its carton, unrolled for usage, with its leg 7 naturally through its inherent resiliency extending upwardly at an approximate perpendicular angle with respect to the base member, and ready for tying to the lower edge of any fence.

Another unique feature of this invention is the provision of a series of drainage openings, as at 11, and which are conveniently spaced at various locations along the length of the upstanding leg, so as to allow rain or other water to conveniently flow therethrough, and not affording any damming of the water thereat, or its flowage under the base member, which may otherwise cause erosion, or excessive build-up of water to one side of the fence, particularly where the fence may be errected upon an inclined ground surface. These drain openings may be of different shapes, as shown, and preferably are widened at their bottom edges to facilitate the flow of water therethrough.

Another unique feature of this invention is that the arrangement of the vegetation barrier at the lower juncture of the formed fence, and having the lateral portions of the base member, as at 3 and 4, extending to either side of the fence, for some distance, any vegetation growth that takes place near the fence will only be outside the marginal edges 5 and 6 of this barrier. Thus, the width of these portions 3 and 4 of the base member are such as to at least accommodate the riding of one wheel of the lawn mower thereover, and thereby allowing the cutting of any vegetation that may be growing just outside the perimeter of the located barrier. Therefore, as previously explained, it is desireable that the barrier of this invention be located in a manner that allows for its pressing downwardly against the ground, which occurs due to the installation of the barrier by forcing its upstanding leg downwardly, before tying in place, so that the lawn mower wheel can easily ride onto this base member, and not encounter any obstacle while overriding the same, or even bind against the edges 5 and 6 thereof, which may otherwise occur if the barrier is not properly installed into close proximity with the ground.

Another advantage of this particular style of barrier is that in the event during its installation some vegetation may already be growing under the lower edge of the fence, when that vegetation ever dies-out, and decays, the barrier of this invention can be once again loosened from its connection with the lower edge of the fence, and forced further downwardly, before being retied in place once again. Or, its convexness will naturally cause its edges 5 and 6 to bias downwardly against the ground.

Variations or modifications to the structure of this invention may occur to those skilled in the art upon reviewing the subject matter of this disclosure. Such variations and modifications, if within the spirit of this invention, are intended to be emcompassed within the scope to any claims to patent protection issuing thereon. The disclosure of this particular invention herein described as the preferred embodiment is done so for illustration purposes only.

Having thus described the invention, what is claimed and desired to be secured by Letters Patent is:

1. An integral fence associated vegetation barrier for eliminating the growth of grass, weeds, or the like, in the vicinity of the lower edges of fencing, comprising a base member designed to locate under the lower edge of such fencing and upon the ground and said base member having a width for extending laterally to either side of the fence to allow clearance for any lawn mower or other cutter to at least partially override thereon during lawn trimming, an upstanding leg integrally formed approximately near the upper center of the base member and extending upwardly for a distance to allow its fixation of the fence, said upstanding leg having at least one apperture provided therethrough to facilitate its tying of the said barrier to any associated fence.

2. The invention of claim 1 and including a series of apertures provided through the said upstanding leg to accommodate the attachment of tie means to facilitate the securement of the barrier to any associated fence.

3. The invention of claim 1 and including at least one drainage hole opening provided through the upstanding leg to allow rain, water, or the like to flow past the barrier.

4. The invention of claim 3 and wherein a series of drain openings are provided through the upstanding leg and spaced along the length of the said upstanding leg.

5. The invention of claim 3 and wherein said drain opening is widened at its bottom edge to facilitate the flow of water therethrough.

6. The invention of claim 1 and including a groove provided along the upstanding leg at the region of its integral connection with the base member and provided for facilitating the folding over of the leg upon the said base member when the latter is rolled into the roll form.

7. The invention of claim 6 wherein said groove is a weakening groove to facilitate the foldover of the said upstanding leg upon its associated base member.

8. The invention of claim 1 and wherein said base member is convexly formed to force its lateral edges against the ground.

* * * * *